US008233818B2

(12) United States Patent
Sasaki et al.

(10) Patent No.: US 8,233,818 B2
(45) Date of Patent: Jul. 31, 2012

(54) INNER CAP FOR TONER CONTAINER AND TONER CONTAINER

(75) Inventors: Tomoe Sasaki, Fuji (JP); Masashi Hasegawa, Numazu (JP); Tetsuya Kusano, Susono (JP); Nobuhiro Makita, Numazu (JP); Makoto Kawaguchi, Numazu (JP); Yoshihide Kawamura, Numazu (JP); Seiji Terazawa, Mishima (JP)

(73) Assignee: Ricoh Company, Ltd., Tokyo (JP)

( * ) Notice: Subject to any disclaimer, the term of this patent is extended or adjusted under 35 U.S.C. 154(b) by 787 days.

(21) Appl. No.: 12/299,977

(22) PCT Filed: Mar. 12, 2008

(86) PCT No.: PCT/JP2008/055020

§ 371 (c)(1),
(2), (4) Date: Nov. 7, 2008

(87) PCT Pub. No.: WO2008/114802

PCT Pub. Date: Sep. 25, 2008

(65) Prior Publication Data

US 2010/0284710 A1 Nov. 11, 2010

(30) Foreign Application Priority Data

Mar. 15, 2007 (JP) ..... 2007-067528
Dec. 19, 2007 (JP) ..... 2007-327701

(51) Int. Cl.
*G03G 15/08* (2006.01)

(52) U.S. Cl. ..... 399/106

(58) Field of Classification Search ..... 399/106, 399/262

See application file for complete search history.

(56) References Cited

U.S. PATENT DOCUMENTS

| | | | | |
|---|---|---|---|---|
| 4,384,032 | A * | 5/1983 | Tashiro et al. | 429/249 |
| 6,134,411 | A * | 10/2000 | Meyer et al. | 399/262 |
| 2002/0131789 | A1 | 9/2002 | Yokoi et al. | |
| 2004/0022559 | A1 * | 2/2004 | Kusano et al. | 399/262 |

FOREIGN PATENT DOCUMENTS

| | | |
|---|---|---|
| JP | 7 257625 | 10/1995 |
| JP | 8 220857 | 8/1996 |
| JP | 9 96959 | 4/1997 |
| JP | 2000 75624 | 3/2000 |

(Continued)

OTHER PUBLICATIONS

Office Action issued Oct. 27, 2011, in Mexican Patent Application No. MX/2011/075000.

*Primary Examiner* — David Gray
*Assistant Examiner* — Gregory H Curran
(74) *Attorney, Agent, or Firm* — Oblon, Spivak, McClelland, Maier & Neustadt, L.L.P.

(57) ABSTRACT

A toner container that can pass not only air but a toner, has toner sealing ability, and does not allow toner leakage even during transportation and an inner pressure change of the container, by placing an air permeable member at the fitting part in the casing part. An inner cap including at least the air permeable member is placed in the casing part of the inner cap, wherein the inner cap is used for a toner container that is detachably mounted to a developing unit in an image forming apparatus using an electrophotographical method, and the toner container includes at least a container main body, the inner cap, and an outer cap.

9 Claims, 7 Drawing Sheets

FOREIGN PATENT DOCUMENTS

| | | |
|---|---|---|
| JP | 2001 42626 | 2/2001 |
| JP | 2001 75349 | 3/2001 |
| JP | 2002 268517 | 9/2002 |
| JP | 2002 278246 | 9/2002 |
| JP | 3509385 | 1/2004 |
| JP | 2004 50123 | 2/2004 |
| JP | 2004 110049 | 4/2004 |
| JP | 2004 279977 | 10/2004 |
| JP | 2004 279978 | 10/2004 |
| JP | 2005 170482 | 6/2005 |
| JP | 2006 106425 | 4/2006 |
| KR | 10-1020696 B1 | 3/2011 |

* cited by examiner

INNER CAP FOR TONER CONTAINER AND TONER CONTAINER

TECHNICAL FIELD

The present invention relates to an inner cap for a toner container and a toner container each of which is replaceable and is used in an image forming apparatus having a developing unit equipped with a toner supplying device.

BACKGROUND ART

As is shown in FIG. 1, a basic toner container for the present invention has an opening part (outlet) 11 for discharging toner particles at one end, which is sealed doubly by an outer cap 20 and an inner cap 30.

One example of the base toner container for the present invention is described below using FIG. 1, which is an illustration showing, however, a structure of conventional toner container. As is shown in FIG. 1, a cylindrical container main body 10 has a neck part 15 of a slightly smaller diameter between the opening part 11 and itself. The neck part 15 is connected to a toner housing part 16 of a larger diameter than it via a shoulder part 14 of a gentle curve, which makes movement of toner to the opening part 11 smooth. The container main body 10 has a guide groove 13 formed in a spiral manner for sending the toner inside to the opening part (discharge spout) 11 by a rotation of the container main body 10. The guide groove 13 is so shaped that it forms a ridge projecting into inside of the container main body.

The outer cap 20 has a female screw part 21 shaped integrally on an inner surface of the wall so that the female screw part 21 screws together a male screw part 12 shaped on the outer surface of the wall of the opening part 11 of the toner container main body 10.

The inner cap 30 has a tapering structure with slightly slender end and slightly large head so that the inner cap seals the opening part 11 when it is pushed into the inner opening part (discharge spout) 11 of the toner container main body 10 and opens the opening part 11 when it is pulled out of the opening part 11. The inner cap 30 has a opening entering part 31 shaped with a flexible resin material. The degree of tapering of the inner cap is so slight that it is difficult to recognize the tapering at a glance. On the outer surface of the opening entering part 31, a plurality of rubbery transverse ribs 33 are circumferentially formed to seal the opening part 11. In this example, they are 3 ribs, i.e., an upper rib 33*a*, a middle rib 33*b*, and a lower rib 33*c*. Further, an inner cap head part 34 forming a base of the tapering opening entering part 31 has a flange part 35 which is equipped with a circumferential fold rib 36 at the outer edge of the flange part 35. A flexible edge of the fold rib 36 is in close contact with a ceiling surface 11*a* to seal the toner container main body. In other words, the inner cap 30 seals the opening part 11 of the toner container main body by two sealing means, i.e., a plurality of rubbery transverse ribs 33 placed on the tapering opening entering part 31 and a fold rib 36. In FIG. 1, a knob part 37 is indicated. The knob part 37 is held by a chuck mechanism placed in an image forming apparatus, when the toner container is disposed at a fixed position in the image forming apparatus to have its sealing broken. By this process the inner cap 30 is immobilized, and removed from the container main body 10 which is moved by a movement mechanism in the image forming apparatus to the direction in which the container main body 10 is leaving away from the inner cap 30. The knob part is particularly useful also in such an inner cap removing step. Such an inner cap removing system is disclosed in detail in our Patent Literatures 1 and 2.

The sealing of the toner container (bottle) is excellent, and the toner container causes no toner leakage. However, the toner container easily causes a difference between the inner pressure and an atmospheric pressure due to an environmental change, such as a temperature change at the storage site of the toner container. Particularly when the toner container is stored at a cold site such as a storage plant in a cold district, the inner pressure of the toner container becomes negative. When the storage period becomes long, cold air is incorporated into the toner container till the inner pressure of the toner container reaches the atmospheric pressure, in spite of the excellent toner sealing ability which is not a complete sealing ability to air. When the toner container in which cold air is incorporated till the inner pressure becomes the atmospheric pressure is brought into a heated room, the inner pressure of the toner container increase as the temperature rises, which causes a drawback of inner cap departure when an outer cap is removed, and the inner pressure increases to a pressure level at which the inner cap can not seal the air in the toner container (Patent Literature 3).

A toner container described in Patent Literature 4 with an inner cap being fixed to a container opening using a screw system causes no drawback of inner cap departure, however, has difficulty in processing of the container opening and the inner cap and requires a complex mechanism for removing the inner cap in an electrophotographic apparatus.

To solve the above problem, a toner container is disclosed in Patent Literature 5 that has a mechanism, placed between a toner container opening and an inner cap, to evacuate an excessive amount of air in the toner container depending on the storage conditions of the toner container. However this toner container shows considerable variation in degree of decreases in inner pressure and costs more for further processing.

In addition this toner container is controlled so that an excessive amount of air is evacuated from an interspace between the inner cap and an outer cap by controlling the tightening torque between the toner container and the outer cap with a low value, which can loosen the outer cap due to drop impact, shaking impact or in handling of the toner container in a cause of transportation of the product, leaving a problem with control of tightening torque of the outer cap.

Further a toner container is disclosed in Patent Literature 6, which is provided with a mechanism that a pressure valve with an elastic body member is placed in a casing part to control the inner pressure responding to an inner pressure change. However, in this toner container, the valve opens at an inner pressure of 0.01 kgf/cm$^2$ or more, which may cause toner leakage when the toner container is laid or turned bottom up, and may cause toner leakage even in normal handling of the toner container by users and during transportation of the toner container.

[Patent Literature 1] Japanese Patent (JP-B) No. 3509385
[Patent Literature 2] Japanese Patent Application Laid-Open (JP-A) No. 2004-110049
[Patent Literature 3] JP-A No. 09-96959
[Patent Literature 4] JP-A No. 08-220857
[Patent Literature 5] JP-A No. 2004-279978
[Patent Literature 6] JP-A No. 2001-75349

DISCLOSURE OF INVENTION

An object of the present invention is to provide an inner cap for a toner container and the toner container which can pass only air but a toner, have toner sealing ability, and do not allow toner leakage even during transportation and an inner pressure change of the container, by placing an air permeable member at the fitting part in the casing part of the inner cap for a toner container.

The above problem can be solved by the present invention described below.

(1) An inner cap for a toner container, having an air permeable member placed in the casing part of the inner cap, wherein the inner cap is used for a toner container that is detachably mounted to a developing unit in an image forming apparatus based on an electrophotographical method, the toner container has a container main body, the inner cap, and an outer cap.

(2) The inner cap for a toner container according to the item (1), wherein the air permeable member has an air permeability of 27.5 s or less when measured by Gurley method according to JIS P8117 and an air permeability of 15 $cm^3 \cdot cm^2/s$ or more when measured by Frazier method according to 6.27.1 A method of JIS L 1096.

(3) The inner cap for a toner container according to any one of the items (1) and (2), wherein the air permeable member is press-fitted against an inner diameter of the casing part and fixed in the casing part with a press fitting allowance of 0.05 mm to 1.5 mm as an external diameter difference.

(4) The inner cap for a toner container according to any one of the items (1) to (3), further having a stopper rib of 0.1 mm to 1.0 mm in height, formed around the inner circumference of the casing part.

(5) The inner cap for a toner container according to any one of the items (1) to (4), wherein the air permeable member is formed in a column-shape, a plate shape or a spherical shape.

(6) The inner cap for a toner container according to any one of the items (1) to (5), wherein the air permeable member in the fitting part of the inner cap is composed of a sintered metal member.

(7) The inner cap for a toner container according to any one of the items (1) to (5), wherein the air permeable member in the fitting part of the inner cap is composed of a foam material.

(8) The inner cap for a toner container according to any one of the items (1) to (7), wherein the air permeable member has a density of 50 $kg/m^3$ to 500 $kg/m^3$.

(9) The inner cap for a toner container according to any one of the items (1) to (8), wherein the air permeable member is inserted into the fitting part by a suction method.

(10) The inner cap for a toner container according to any one of the items (1) to (9), composed of polyethylene.

(11) A toner container having a container main body, an inner cap, and an outer cap, wherein the toner container is detachably mounted to a developing unit in an image forming apparatus based on an electrophotographic method, and the inner cap is an inner cap according to any one of the items (1) to (10).

(12) The toner container according to the item (11), wherein the outer cap has a non-contact portion being in non-contact with the inner cap at a position where the outer cap is in contact with the inner cap and makes contact with the inner cap in a discontinuous manner.

(13) The toner container according to the item (12), wherein the non-contact portion of the outer cap being in non-contact with the inner cap is concave.

(14) The toner container according to any one of the items (12) to (13), wherein the contact portion of the outer cap being in contact with the inner cap is convex.

(15) The toner container according to any one of the items (11) to (14), wherein the outer cap has a tightening torque of 110 N to 230 N.

(16) An image forming apparatus, equipped with a toner container according to any one of the items (11) to (15).

By the present invention it becomes possible to provide a toner container which can pass only air but a toner, has toner sealing ability, and does not allow toner leakage even during transportation and inner pressure change of the container, by placing an air permeable member at the fitting part in a casing part of an inner cap.

BEST MODE FOR CARRYING OUT THE INVENTION

An inner pressure adjusting mechanism for adjusting the inner pressure of the toner container of the present invention, which is placed between an opening part of the toner container and an inner cap, is described by reference to figures.

Figure 1:
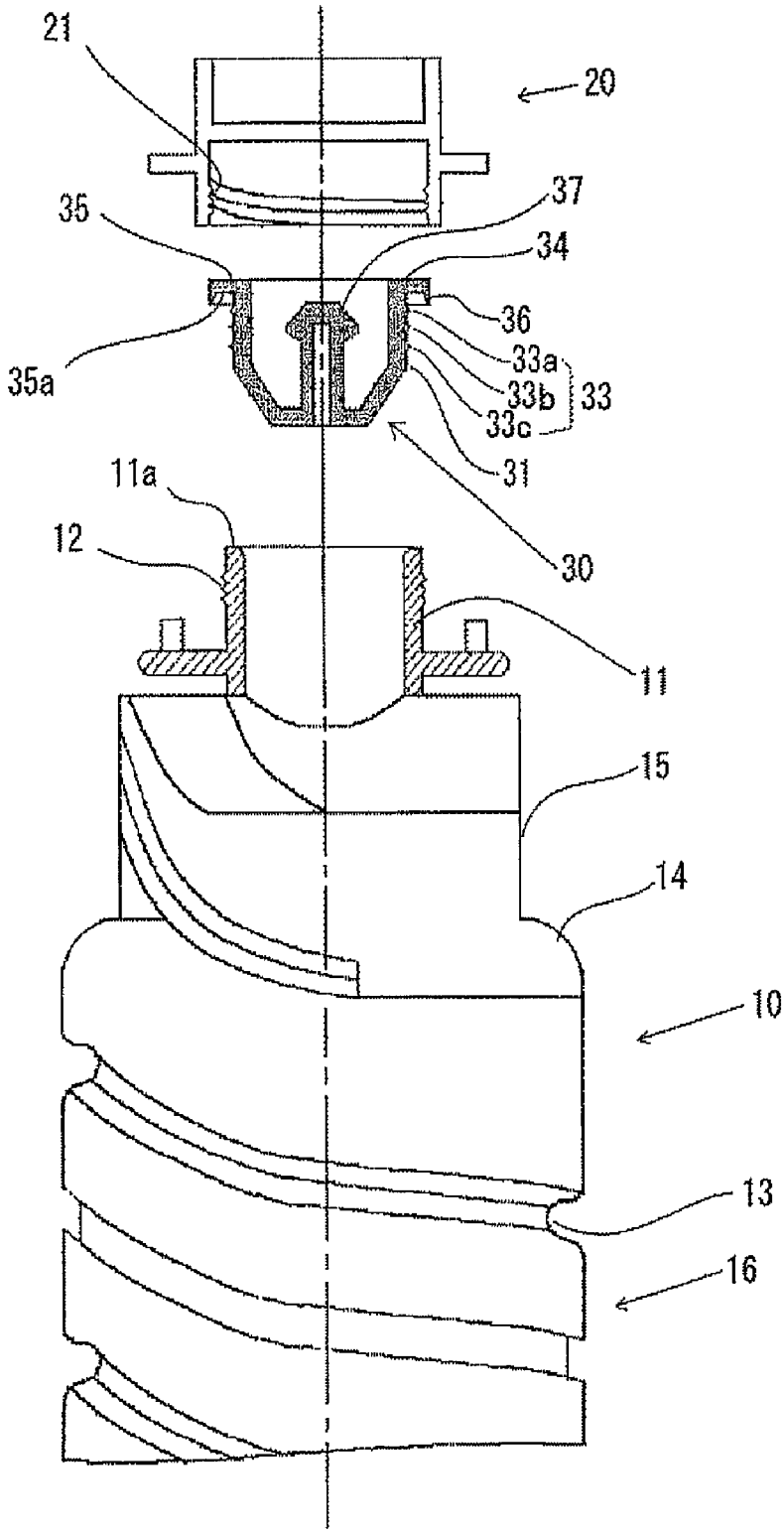
FIG. 1 is a view showing a configuration of a conventional toner container including an inner cap and an outer cap.

FIG. 1 is a view schematically showing a basic configuration example of the toner container of the present invention composed of a toner container main body 10, an inner cap 30, and an outer cap 20. As described above, the outer cap 20 is a cap for preventing the inner cap 30 from falling off even when the inner cap is subject to some external force during transportation and storage. The inner cap 30 is so constructed that it detachably mounted to an opening part of the toner container 11 in a developing device. The present invention does not exclude this basic configuration itself, rather includes it, however this basic configuration is already described above and is not described here again.

Figure 2:
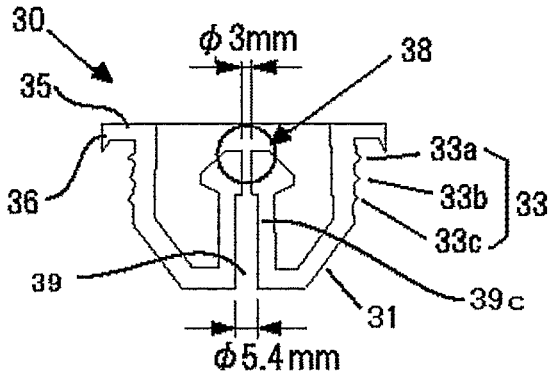
FIG. 2 is a view showing the casing part of an inner cap formed with an air hole of 3 mm in diameter in the upper part of the fitting part of the inner cap and the fitting part of 5.4 mm in diameter.

FIG. 2 is a view showing a casing 39*c* of an inner cap provided with an air hole 38 of 3 mm in diameter in the upper part of the fitting part of the inner cap and a ventilation part 39 of 5.4 mm in diameter.

Figure 3:
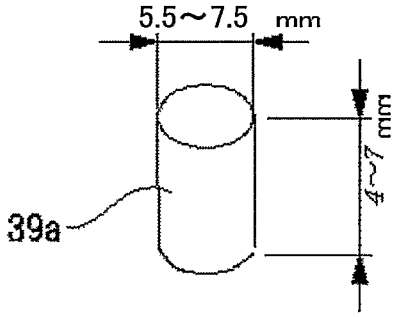
FIG. 3 is a view showing a shape of an air permeable member (urethane foam).

FIG. 3 shows an air permeable member 39*a* to be inserted into the ventilation part 39. The air permeable member 39*a* is made of urethane foam and has a diameter of 5.5 mm to 7.5 mm and a height of 4 mm to 7 mm, and is so constructed that it can pass only air but toner particles.

Figure 4:
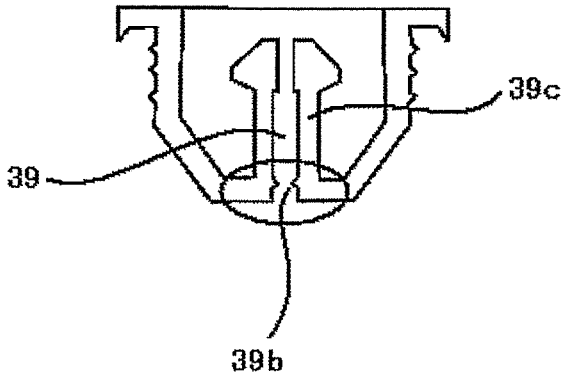
FIG. 4 is a view showing a stopper rib for an air permeable member provided around the circumference of the inner surface of the fitting part wall.

FIG. 4 is a view showing a stopper rib 39*b* for an air permeable member 39*a* provided around the circumference of ventilation part 39. The stopper rib 39*b* prevents an air permeable member 39*a* from falling in case of reduced pressure inside the toner container or of receiving an impact.

Figure 5:
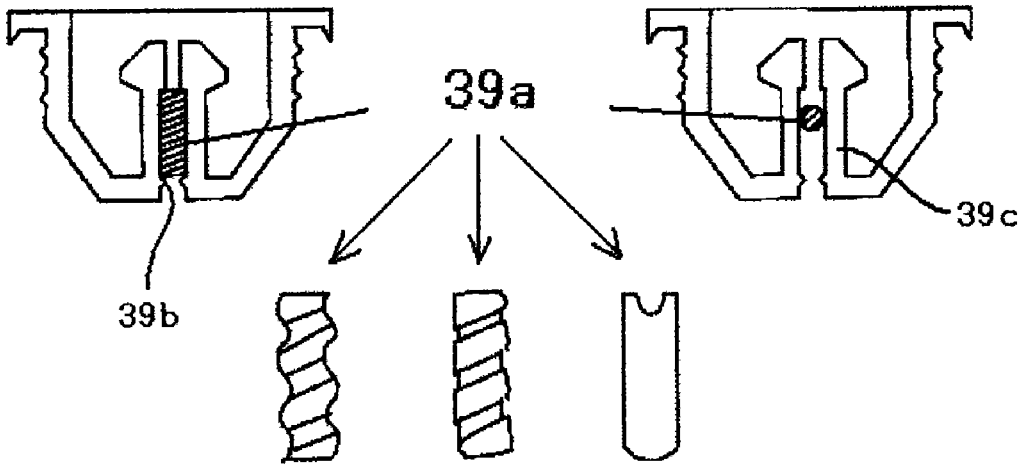
FIG. 5 is a view showing an air permeable member inserted into a ventilation part.
Figure 6:
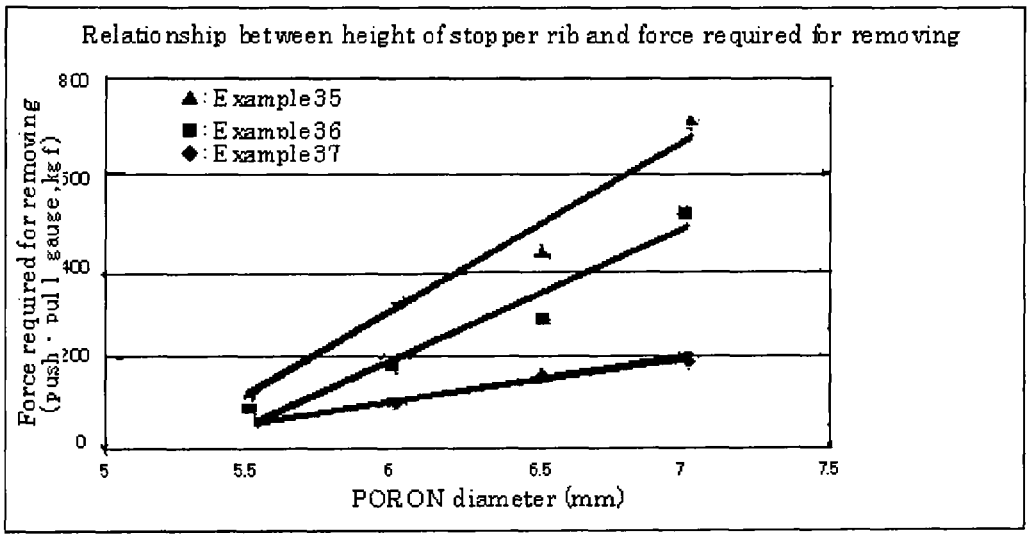
FIG. 6 is a graph showing a result of evaluation of relationship between a height of stopper rib 39*b* of an air permeable member and a force required to pull out an air permeable member 39*a*.

FIG. 5 shows a state in which an air permeable member 39*a* is inserted into a ventilation part 39. By placing an inner cap with the ventilation part with an air permeable member in this state in the toner container, the inner cap passes only air but toner particles and prevents an increase of inner pressure, which is an effect of the present invention.

Thus the present invention provides a toner container detachably mounted to a developing device in an image forming apparatus using an electrophotographic method, composed of at least a toner container main body 10, an inner cap 30, and an outer cap 20, wherein an air permeable member is placed in a casing part 39*c* of the inner cap 30, whereby gas therein is discharged from an interspace between the air permeable member 39*a* and the wall of the casing part 39*c* and from through the air permeable member 39*a* itself when the inner pressure of the toner container becomes higher than atmospheric pressure. This makes the inner pressure of the toner container decreased to the atmospheric pressure and can prevent the inner cap 30 from falling off. Furthermore, when the inner pressure of the toner container is reduced relative to atmospheric pressure in case of transportation by air or transportation from a highland of an altitude of 2,000 m to a level ground, the air permeable member in the casing part 39*c* in the inner cap 30 does not fall into the toner container main body 10.

Meanwhile, the air permeability of an air permeable member 39*a* placed in the casing part 39*c* in the inner cap is preferably 27.5 s or less when measured by Gurley method, and the air permeability is preferably 15 $cm^3 \cdot cm^2/s$ or more when measured by Frazier method. By adjusting the air permeability of the air permeable member in this range, an excessive amount of gas in the toner container main body 10 is discharged to outside and the inner pressure of the toner container main body 10 can be decreased to atmospheric pressure. When the air permeability of the air permeable member is higher than 27.5 s as measured by Gurley method and is lower than 15 $cm^3 \cdot cm^2/s$ as measured by Frazier method, it is difficult to discharge gas in the toner container main body 10 to outside, resulting in degraded inner pressure decreasing effect of the toner container.

Meanwhile, in a process of fixing the air permeable member 39*a* in the casing part 39*c*, the air permeable member 39*a* is so constructed that it is press fitted against an inner diameter of the casing part 39*c*, and the press fitting allowance is set to 0.05 to 1.5 as an external diameter difference, which prevents the air permeable member 39*a* from falling from the casing part 39*c* and makes it easy to attach the air permeable member into the casing part 39*c*. When the press fitting allowance is less than 0.05 as an external diameter difference, the air permeable member 39*a* falls off from the casing part 39*c* due to shaking impact or drop impact to cause toner leakage. When the press fitting allowance is greater than 1.5 as an external diameter difference, it is difficult to attach the air permeable member 39*a* into the casing part 39*c*, and it takes time to insert the air permeable member 39*a* to the casing part 39*c*, resulting in degraded workability.

By placing a stopper rib having a height of 0.1 mm to 1.0 mm around the circumference of the inner surface of the casing part 39*c*, the air permeable member 39*a* is prevented from falling off from the casing part 39*c* in the case where the toner container is shaken, dropped, or the inner pressure thereof is depressurized.

In addition, a test for the present invention confirmed that it is preferable to place a stopper rib 39*b* of a height of 0.2 mm to 0.5 mm. When a stopper rib of a height of less than 0.2 mm is placed around the circumference of inner surface of the casing part 39*c*, in case of the toner container being shaken, dropped, and depressurized, the air permeable member 39*a* falls off from the casing part 39*c* to cause toner leakage. When a stopper rib of a height of more than 0.5 mm is placed around the circumference of the inner surface of the casing part 39*c*, it becomes difficult to insert the air permeable member 39*a* into the casing part 39*c*, resulting in degraded workability.

By using the air permeable member 39*a* formed in a column-shape, a plate shape or a spherical shape, as shown in FIG. 5, the inner cap effectively passes only air but toner particles and prevents an inner pressure rise.

Furthermore, when the air permeable member 39*a* placed in the ventilation part 39 in the inner cap 30 is composed of a sintered metal member such as a sintered metal copper based tablet and a molded material composed of stainless steel or a resin powder, the inner cap effectively passes only air but toner particles and prevents an inner pressure rise. As a result of the experimental test, it was found that, for example, ESP manufactured by SMC Corporation is effective as the sintered metal member.

Further, when the air permeable member 39*a* placed in the ventilation part 39 in the inner cap 30 is composed of a foam material such as urethane foam, the inner cap effectively passes only air but toner particles and prevents an inner pressure rise. Examples of the foam material include EP1000G, MOLTOPREN SM-55, PORON LE-20, and PORON L-24 (a foam having a high density, minute, homogenous cell structure) manufactured by INOAC CORPORATION. As a result of the experimental test, it was found that PORON L-24 passes only air and causes no toner leakage.

By setting the density of the air permeable member 39*a* in the range of 50 $kg/m^3$ to 500 $kg/m^3$, an effect of decreasing the inner pressure of the toner container can be obtained. As a result of the experimental test for the present invention, it was found that the density of the air permeable member 39*a* is preferably in the range of 100 $kg/m^3$ to 300 $kg/m^3$.

To insert the air permeable member 39*a* into the ventilation part 39, a suction method is used to insert the air permeable member 39*a* into the casing part 39*c*, which makes the insertion easy and results in excellent workability. The insertion of the air permeable member 39*a* by a suction method allows for carrying out an air leakage test at the same time and allows for preventing the air permeable member 39*a* from falling off.

By using polyethylene or polyethylene resin having a low density as material for the inner cap 30, the inner cap 30 of the present invention is provided which has an appropriate hardness and an appropriate flexibility and is formable in a shape relatively easily for its elaborate structure.

In addition, the present invention preferably further includes a structural mechanism which enables leaked air from such an inner cap 30 described above to flow outside of the outer cap 20. Examples of the structural mechanism are described below with reference to FIGS. 8 to 11.

Figure 8A:
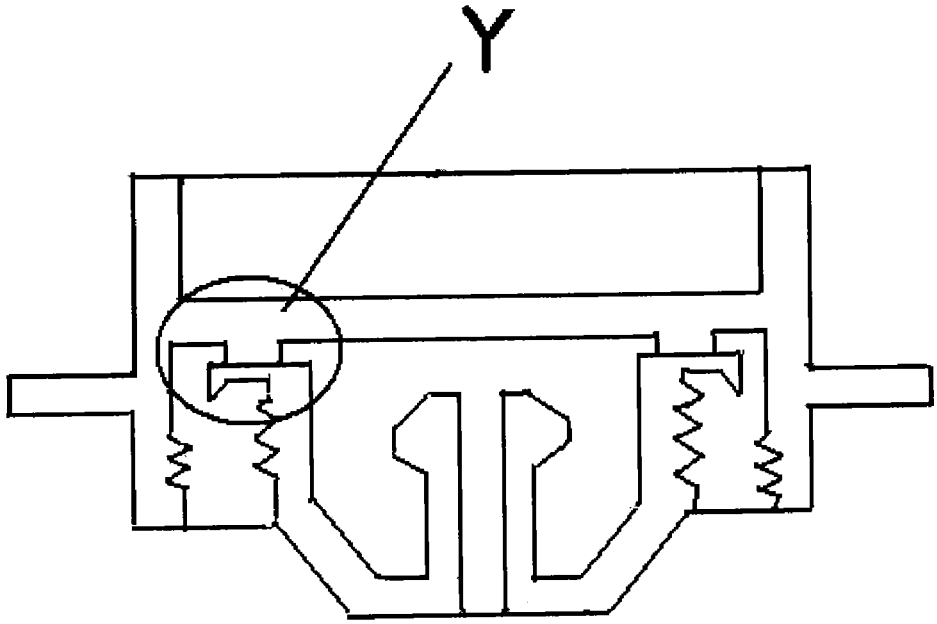
FIG. 8A is a cross-section view of an outer cap and an inner cap.
Figure 8B:
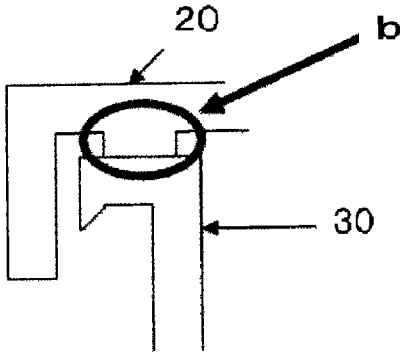
FIG. 8B is a magnified view of Y part in FIG.8A, showing that the contact portion of the outer cap being in contact with the inner cap is convex.
Figure 9:
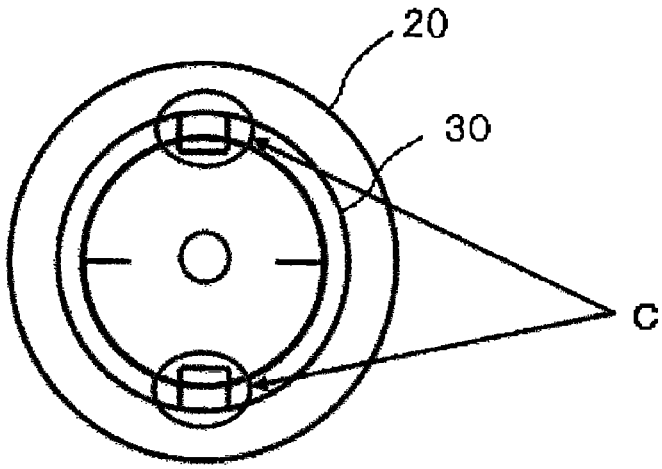
FIG. 9 is an overhead view of the inner part of the outer cap, showing that the non-contact portion of the outer cap being in non-contact with the inner cap is concave.
Figure 10:
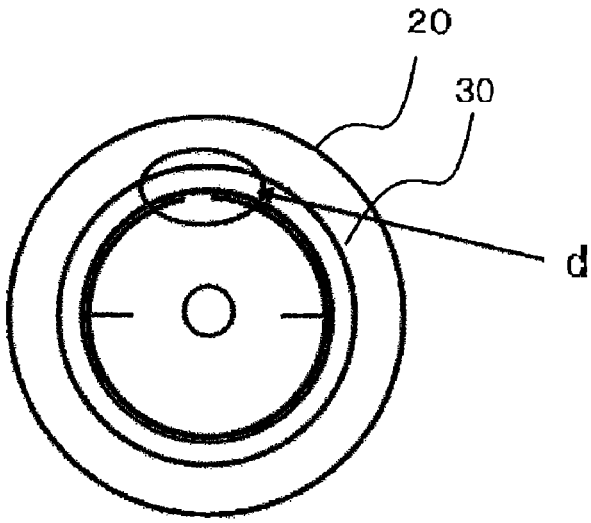
FIG. 10 is an overhead view of the inner part of the outer cap, showing that the contact portion of the outer cap being in contact with the inner cap is convex.

As is shown in FIG. 8B, such a structural mechanism may be a structural mechanism in which an outer cap 20 partly has a non-contact portion being in non-contact with an inner cap 30 at a position where the outer cap 20 is in contact with the inner cap 30 and makes contact with the inner cap 20 in a discontinuous manner. That is, the non-contact portion of the outer cap being in non-contact with the inner cap may have a concave, as is shown in FIG. 8B-*a* and FIG. 10. Alternatively, the contact portion of the inner cap 30 being in contact with the outer cap 20 may have a convex, as is shown in FIG. 9B-*b*, or as is shown in FIG. 11, a non-contact portion may be provided in the contact portion of the inner cap 30 being in contact with the outer cap 20. FIG. 10-*c* indicates non-contact portions of the outer cap, and FIG. 11-*d* indicates a non-contact portion of the outer cap that is not contact with the inner cap, where a convex shape is not continuous.

By providing a non-contact portion in a part of the outer cap where the outer cap would be in contact with the inner cap and forming the contact portion of the outer cap being in contact with the inner cap in a discontinuous manner, it is possible to flow leaked air from the inner cap to outside of the outer cap.

By forming a concave in a contact portion of the outer cap being in contact with the inner cap, it is possible to secure a non-contact portion of the outer cap being in non-contact with the inner cap. In addition, since the concave can be formed with a die, the concave can be formed with ease, the dimensional stability thereof can be secured, and, leaked air from the inner cap can be assuredly flowed to outside of the outer cap.

By forming a convex in a contact portion of the outer cap being in contact with the inner cap, the convex portion of the outer cap makes contact with the inner cap, and non-contact portions of the outer cap become in non-contact with the inner cap, which makes leaked air from the inner cap flow outside of the outer cap. In addition, since the convex can be formed with a die, the convex can be formed with ease, the dimensional stability thereof can be secured, and, leaked air from the inner cap can be assuredly flowed to outside of the outer cap.

The configuration of the outer cap having a non-contact portion in the contact portion being contact with the inner cap, the outer cap can be tightened up sufficiently, and even under the condition where the tightening torque of the outer cap is in the range of 110N to 230N, leaked air from the inner cap can be assuredly flowed to outside of the outer cap. When the tightening torque is 110 N or less, the outer cap can be loosened by drop impact, shaking impact and in handling of the toner container during transportation of the product. In contrast, when the tightening torque is 230 N or more, there may be a complaint that the outer cap can not be pulled out at the time of setting the toner container, although the outer cap is not loosened by drop impact, shaking impact and in handling of the toner container.

The present invention can provide a toner container which does not leak toner particles even under changes in atmospheric pressure during transportation and storage, and the present invention can provide an image forming apparatus equipped with this type of toner container, allowing smooth toner supply.

EXAMPLES

Hereinafter, the inner cap and the toner container of the present invention will be further described in detail referring to Examples.

Examples 1 to 10 and Comparative Examples 1 to 4

Evaluation of Degree of Inner Cap Falling Out

Testing Method

The following is a description of the testing method.

(Evaluation Method of Degree of Cap Falling Out)

Holes were formed on the toner containers, and as various air ventilating units, inner caps 30 were respectively set into the individual casing parts 39*c* of the prepared toner containers. For example, an inner cap 30 in which a air permeable member 39*a* was inserted in a casing part 39*c*, an inner cap 30 with a porous filter stuck in a casing part 39*c*, an inner cap 30 used for Comparative Examples 1 and 2 in which only a vertical convex rib was placed around the outer circumference thereof for comparison, and an inner cap 30 for Comparative Examples 3 and 4 in which only a concave groove was placed for comparison were set in the toner containers of the same specification. Then, an outer cap 20 provided with a concave at a contact position being in contact with each inner cap or an outer cap 20 provided with a convex at a contact position being in contact with each inner cap was put on each of the toner containers. Thereafter, torque was adjusted to a fixed value, the thus prepared toner container was left in an incubator at 0° C. for two hours. After two hours, the hole formed on the toner container was closed, and the toner container was left in a drying machine at 50° C. for 30 min. After 30 min, the toner container was brought out from the drying machine, and the outer cap was pulled out to check whether the inner cap 30 fell out of the toner container. In Examples 1 to 4, a filter was inserted into the casing part as an air permeable member, and in Examples 5 to 10, a porous air permeable member was inserted into the casing part. The results are as follows.

TABLE 1

| | Example | Air permeable member used | Thickness (mm) | Air permeability: Gurley (sec) | Air permeability: Frazier ($cm^3 \cdot cm^2/s$) | Waterproofness (kPa) | Result |
|---|---|---|---|---|---|---|---|
| Example using filter | Ex. 1 | DuPont ™ TYVEK 1073B | 0.19 | 22 | No data | No data | A |
| | Ex. 2 | NTF 1003-K02 (Nitto Denko Corp.) | 0.15 | No data | 5 | 7 | A |
| | Ex. 3 | NTF 1026-K02 (Nitto Denko Corp.) | No data | 10 | No data | 200 | A |
| | Ex. 4 | NTF 3441-K02 (Nitto Denko | 0.3 | No data | 35 | 2 | A |

TABLE 1-continued

| | | | | | | | | |
|---|---|---|---|---|---|---|---|---|
| | | Corp.) | | | | | | |
| | Example | Air permeable member | Density (kg/m$^3$) | Hardness (N) | Tensile strength | Elongation (%) | Compression Residual strain (%) | Result |
| Example using porous air permeable member | Ex. 5 | F-1000G −12 mm, 6 mm di. (INOAC Corp.) | 50.3 | 109.8 | 91 | 170 | 7.2 | A |
| | Ex. 6 | F-1000G −8 mm, 6 mm di. (INOAC Corp.) | 50.3 | 109.8 | 91 | 170 | 7.2 | A |
| | Ex. 7 | SM55 −12 mm, 6 mm di. (INOAC Corp.) | 57 ± 5 | No data | 98 or more | 100 or more | No data | A |
| | Ex. 8 | SM55 −8 mm, 6 mm di. (INOAC Corp.) | 57 ± 5 | No data | 98 or more | 100 or more | No data | A |
| | Ex. 9 | LE20 −6 mm, 6 mm di. (INOAC Corp.) | 200 | No data | 0.3 | 150 | 7.9 | A |
| | Ex. 10 | L24 −6 mm, 6 mm di. (INOAC Corp.) | 240 | No data | 0.54 | 115 | 2.7 | A |

| | | Air permeable member | Height of rib (mm) | Result |
|---|---|---|---|---|
| With only vertical convex rib | Comp Ex. 1 | None | 0.4 | B |
| | Comp Ex. 2 | None | 0.2 | B |

| | | | Depth of groove (mm) | Result |
|---|---|---|---|---|
| With only concave groove | Comp Ex. 3 | None | 0.2 | B |
| | Comp Ex. 4 | None | 0.1 | B |

In the column of Result in Table 1, "A" means that the inner cap did not fall out and "B" means that the inner cap fell out. In Table 1, "No data" means that data was not found in the product catalogue of manufacturer.

Examples 11 to 18 and Comparative Examples 5 to 8

Evaluation of Toner Leakage Caused by Shaking Impact

Method of Shaking Test

In each of the toner containers, an inner cap with an air permeable member inserted into the casing part was set, and each outer cap having a concave shape or a convex shape was set to each non-contact portion of the each outer cap being in non-contact with each inner cap. The toner containers thus prepared were put in a carton, and the carton was vibrated under the conditions described below using a vertical vibration tester. The toner containers were observed whether the used toner leaked from the toner container. Results are shown in Table 2.

(Conditions)

Acceleration: 1G
Frequency: 5 Hz-50 Hz
Vibration time: 53.3 min
Vibration direction: vertical

TABLE 2

| | Example | Air permeable member used | Result |
|---|---|---|---|
| Example using filter | Ex. 11 | Same as Ex. 2 (NTF1003-K02, Nitto Denko Corp.) | A |
| | Ex. 12 | Same as Ex. 3 (NTF1026-K02, Nitto Denko Corp.) | A |
| | Ex. 13 | Same as Ex. 4 (NTF3441-K02, Nitto Denko Corp.) | B |
| | Ex. 14 | Same as Ex. 1 (DuPont ™ TYVEK 1073B) | A |
| Example using porous air permeable member | Ex. 15 | Same as Ex. 6 (F-1000G-8 mm, ϕ 6 mm, INOAC Corp.) | B |
| | Ex. 16 | Same as Ex. 8 (SM55-8 mm, ϕ 6 mm, INOAC Corp.) | B |
| | Ex. 17 | Same as Ex. 9 (LE20-6 mm, ϕ 6 mm, INOAC Corp.) | A |
| | Ex. 18 | Same as Ex. 10 (L24-6 mm, ϕ 6 mm, INOAC Corp.) | A |

| | Comparative Example | | Air permeable member | Result |
|---|---|---|---|---|
| With only vertical convex rib | Comp. Ex. 5 | Same as Comp. Ex. 1 | None | A |
| | Comp. Ex. 6 | Same as Comp. Ex. 2 | None | A |
| With only concave groove | Comp. Ex. 7 | Same as Comp. Ex. 3 | None | A |
| | Comp. Ex. 8 | Same as Comp. Ex. 4 | None | A |

In the column of Result in Table 2, "A" means that the toner did not leak from the toner container, and "B" means that the toner leaked from the toner container.

Examples 19 to 26 and Comparative Examples 9 to 12

Evaluation of Toner Leakage Due to Drop of Toner Container

Method of Dropping Test

The toner containers were individually dropped from a height of 80 cm at eight times, and whether or not the toner leaked from the opening part was checked. Results are shown in Table 3.

TABLE 3

| | Example | Air permeable member used | Result |
|---|---|---|---|
| Example using filter | Ex. 19 | Same as Ex. 2 (NTF1003-K02, Nitto Denko Corp.) | A |
| | Ex. 20 | Same as Ex. 3 (NTF1026-K02, Nitto Denko Corp.) | A |
| | Ex. 21 | Same as Ex. 4 (NTF3441-K02, Nitto Denko Corp.) | B |
| | Ex. 22 | Same as Ex. 1 (DuPont ™ TYVEK 1073B) | A |
| Example using porous air permeable member | Ex. 23 | Same as Ex. 6 (F-1000G-8 mm, 6 mm di., INOAC Corp.) | B |
| | Ex. 24 | Same as Ex. 8 (SM55-8 mm, 6 mm di., INOAC Corp.) | B |
| | Ex. 25 | Same as Ex. 9 (LE20-6 mm, 6 mm di., INOAC Corp.) | A |
| | Ex. 26 | Same as Ex. 10 (L24-6 mm, 6 mm di., INOAC Corp.) | A |

| | Comparative Example | | Air permeable member | Result |
|---|---|---|---|---|
| With only vertical convex rib | Comp. Ex. 9 | Same as Comp. Ex. 1 | None | B |
| | Comp. Ex. 10 | Same as Comp. Ex. 2 | None | A |
| With only concave groove | Comp. Ex. 11 | Same as Comp. Ex. 3 | None | B |
| | Comp. Ex. 12 | Same as Comp. Ex. 4 | None | A |

In the column of Result in Table 3, "A" means that after the toner containers were individually dropped from a height of 80 cm at 8 times, the toner did not leak from the opening part of the toner container, and "B" means that the toner leaked from the opening of the toner container.

Examples 27 to 34 and Comparative Examples 13 to 16

Evaluation of Recovery of Inner Pressure at a Recovered Temperature from a Low Temperature Measurement Method (1) Measurement of Inner Pressure Even when a toner container was transported by air or stored at a low temperature, it is desirable that once the toner container is set in an image forming apparatus, the cap thereof be removed promptly by a given cap-removing operation by the image forming apparatus and a toner be supplied promptly to regions to be developed. For this purpose, the toner container is preferably capable of eliminating the negative pressure in the toner container promptly. In this evaluation, a tube was inserted to a toner container, an inner cap and an outer cap were fixed to the toner container, tightening torque of the outer cap was adjusted to a fixed value, and the each of the toner containers were left in a incubator at 0° C. for two hours. Then, the toner container was brought into a drying machine at 50° C., and a change of inner pressure of the toner container, caused by a temperature difference of 50° C. was measured using a sensor. Results are shown in Table 4.

TABLE 4

| | Example | Air permeable member used | Result |
|---|---|---|---|
| Example using filter | Ex. 27 | Same as Ex. 2 (NTF1003-K02, Nitto Denko Corp.) | A |
| | Ex. 28 | Same as Ex. 3 (NTF1026-K02, Nitto Denko Corp.) | A |
| | Ex. 29 | Same as Ex. 4 (NTF3441-K02, Nitto Denko Corp.) | A |
| | Ex. 30 | Same as Ex. 1 (DuPont ™ TYVEK 1073B) | A |
| Example using porous air permeable member | Ex. 31 | Same as Ex. 6 (F-1000G-8 mm, 6 mm di., INOAC Corp.) | A |
| | Ex. 32 | Same as Ex. 8 (SM55-8 mm, 6 mm di., INOAC Corp.) | A |
| | Ex. 33 | Same as Ex. 9 (LE20-6 mm, 6 mm di., INOAC Corp.) | A |
| | Ex. 34 | Same as Ex. 10 (L24-6 mm, 6 mm di., INOAC Corp.) | A |

| | Comparative Example | | Air permeable member | Result |
|---|---|---|---|---|
| With only vertical convex rib | Comp. Ex. 13 | Same as Comp. Ex. 1 | None | B |
| | Comp. Ex. 14 | Same as Comp. Ex. 2 | None | B |
| With only concave groove | Comp. Ex. 15 | Same as Comp. Ex. 3 | None | B |
| | Comp. Ex. 16 | Same as Comp. Ex. 4 | None | B |

In the column of Result in Table 4, "A" means that when the temperature of the toner container was changed from a low temperature to a high temperature, the inner pressure of the toner container increased once, but the force required to remove the inner cap as a measure indicating the inner pressure was decreased to 0.4 kgf or less in 30 min, and "B" means that the once increased inner pressure did not decreased.

Examples 35 to 37

Evaluation of Force Required to Remove Air Permeable Member 39*a*

Figure 7A:
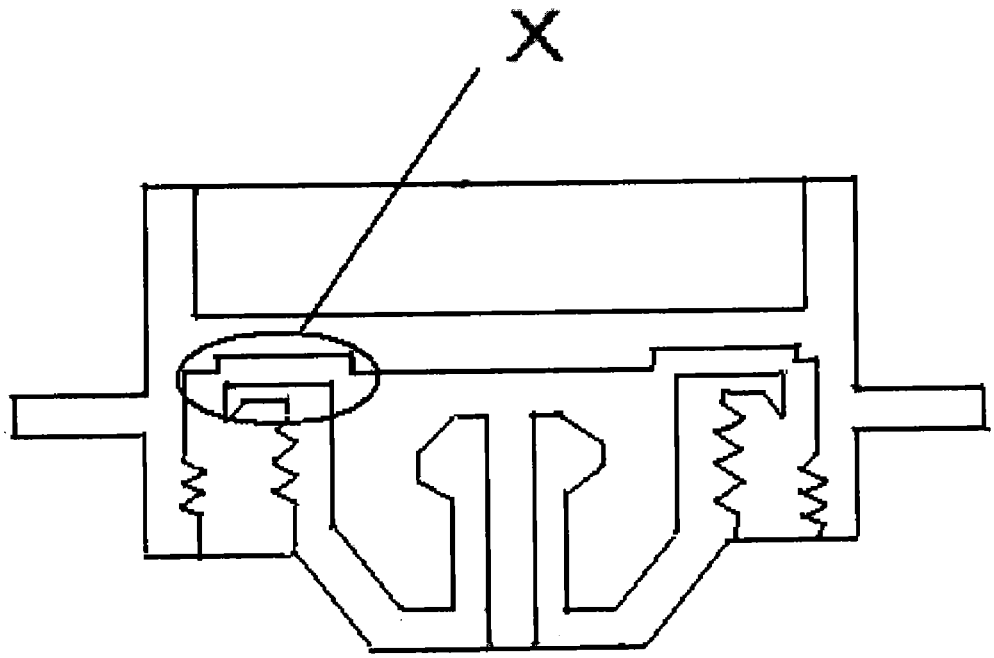
FIG. 7A is a cross-section view of an outer cap and an inner cap.
Figure 7B:
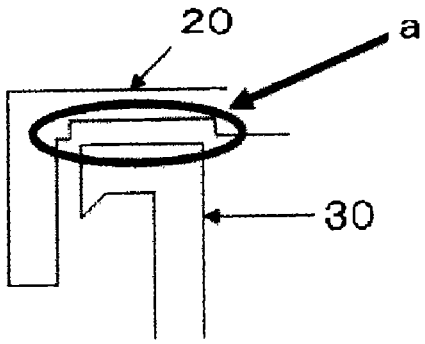
FIG. 7B is a magnified view of X part in FIG.7A, showing that the non-contact portion of the outer cap being in non-contact with the inner cap is concave.

A relationship between a height of the stopper rib 39*b* for air permeable member material used in Examples 9, 10, 17, 18, 25, 26, 33, and 34 and a force required to remove the air permeable member 39*a* was evaluated. Results are shown in FIG. 7 as relationships between diameters of air permeable members and the forces required to remove them when the height of stopper rib is 0.4 mm (Example 35), when the height of stopper rib is 0.3 mm (Example 36), and when stopper rib is absent (Example 37).

Example 38

Evaluation of Whether or not Air Permeable Members 39*a* Falls Off Under Reduced Pressure In addition, whether or not the stopper rib 39*b* could prevent the used air permeable member from falling off under reduced pressure was evaluated using an air permeable member L24 (manufactured by INOAC Corp.). Results are shown in Tables 5 and 6.

TABLE 5

| | | Height of rib | | |
|---|---|---|---|---|
| | | No rib | 0.3 mm | 0.4 mm |
| PORON diameter | 5.5 mm | Unable to measure | 16 | 16 |
| | 6.0 mm | 18 | 20 | 20 |
| | 6.5 mm | 18 | 20 | 20 |
| | 7.0 mm | 16 | 20 | 20 |

Unit: cmHg

TABLE 6

| | | Whether PORON fell or not | | |
|---|---|---|---|---|
| | | No rib | 0.3 mm | 0.4 mm |
| PORON diameter | 5.5 mm | Fell | Not | Not |
| | 6.0 mm | Not | Not | Not |
| | 6.5 mm | Not | Not | Not |
| | 7.0 mm | Not | Not | Not |

Example 39

Evaluation of Easiness to Open Outer Cap in Relation to Tightening Torque Thereof Further, a relationship between tightening torque of outer caps and easiness with which outer caps were opened and toner leakage was evaluated according to the following criteria. For inner caps those equipped with an air permeable member L24 (manufactured by INOAC Corp.) were used, and for outer caps those with a concave non-contact portion were used. Results are shown in Table 7.

Evaluation Criteria for Toner Leakage Caused by Drop Impact and Shaking Impact

A: No toner leakage found.

B: The toner was set inside the outer cap, although a small amount of toner bleeding was observed.

C: The toner leaked outside the outer cap.

Evaluation Criteria for Easiness of Pulling Outer Cap

A: The outer cap could be pulled out with ease.

B: The outer cap could be pulled out.

C: The outer cap could be pulled out, but with some difficulty.

D: The outer cap could not be pulled out.

TABLE 7

| Tightening torque of outer cap (N) | Drop impact | Shaking impact | Operability Easiness to pull out outer cap |
|---|---|---|---|
| 70 | B | B | A |
| 110 | A | A | A |
| 160 | A | A | B |
| 190 | A | A | B |
| 230 | A | A | B |
| 250 | A | A | D |

INDUSTRIAL APPLICABILITY

A replaceable toner container of the present invention to be used in a developing device and an image forming apparatus equipped with a toner supplying device can be used as a powder housing container in which some inner pressure controlling mechanism is required.

The invention claimed is:

1. An inner cap for a toner container, comprising:

an air permeable member in a casing part of the inner cap, wherein the inner cap is used for a toner container that is detachably mounted to a developing unit in an image forming apparatus based on an electrophotographical method, and the toner container comprises a container main body, the inner cap, and an outer cap, wherein the inner cap comprises a triangular-shape stopper rib of 0.1 mm to 1.0 mm in height, around an inner circumference of the casing part between a bottom surface and a ceiling surface of the inner cap, wherein the air permeable member includes a foam material having a column-shape, and is inserted into a fitting part by a suction method, wherein the air permeable member is press-fitted against an inner diameter of the casing part and fixed in the casing part with a press fitting allowance of 0.05 mm to 1.5 mm as an external diameter difference.

2. The inner cap for a toner container according to claim 1, wherein the air permeable member has an air permeability of 27.5 s or less when measured by Gurley method according to JIS P8117 and an air permeability of 15 $cm^3 \cdot cm^2/s$ or more when measured by Frazier method according to 6.27.1 A method of JIS L 1096.

3. The inner cap for a toner container according to claim 1, wherein the air permeable member has a density of 50 $kg/m^3$ to 500 $kg/m^3$.

4. The inner cap for a toner container according to claim 1, composed of polyethylene.

5. A toner container, comprising:

a container main body, an inner cap according to claim 1, and an outer cap, wherein the toner container is for being detachably mounted to a developing unit in an image forming apparatus which uses an electrophotographic method, and the inner cap is an inner cap that includes an air permeable member in a casing part of the inner cap, wherein the air permeable member includes a foam material having a density of 50 $kg/m^3$ to 500 $kg/m^3$, and is inserted into a fitting part by a suction method, wherein the outer cap has a non-contact portion which does not contact the inner cap at a position where the outer cap is in contact with the inner cap and contacts the inner cap in a discontinuous manner.

6. The toner container according to claim 5, wherein the non-contact portion of the outer cap is concave.

7. The toner container according to claim 5, wherein the contact portion of the outer cap in contact with the inner cap is convex.

8. The toner container according to claim 5, wherein the outer cap has a tightening torque of 110 N to 230 N.

9. An image forming apparatus, comprising:

a toner container according to claim 5.

* * * * *